US005141916A

United States Patent [19]

Katayama et al.

[11] Patent Number: 5,141,916

[45] Date of Patent: Aug. 25, 1992

[54] THERMAL TRANSFER IMAGE RECEPTION PAPER

[75] Inventors: Shigeru Katayama; Hiroshi Matsumoto; Tatuo Wada, all of Osaka, Japan

[73] Assignee: Nitto Denko Corporation, Osaka, Japan

[21] Appl. No.: 564,660

[22] Filed: Aug. 9, 1990

Related U.S. Application Data

[63] Continuation of Ser. No. 411,284, Sep. 22, 1989, abandoned.

[30] Foreign Application Priority Data

Sep. 22, 1988 [JP] Japan ..... 63-238115

[51] Int. Cl.[5] ..... B41M 5/035; B41M 5/26

[52] U.S. Cl. ..... 503/227; 428/211; 428/215; 428/216; 428/319.3; 428/334; 428/335; 428/336; 428/511; 428/513; 428/910; 428/913; 428/914

[58] Field of Search ..... 8/471; 428/195, 211, 428/212, 913, 914, 215, 216, 319.3, 334-336, 511, 513, 910; 503/227

[56] References Cited

U.S. PATENT DOCUMENTS 4,720,480 1/1988 Ito et al. ..... 503/227
4,778,782 10/1988 Ito et al. ..... 503/227

FOREIGN PATENT DOCUMENTS 0234563 9/1987 European Pat. Off. ..... 503/227
0275319 7/1988 European Pat. Off. ..... 503/227

OTHER PUBLICATIONS

Patent Abstracts of Japan, vol. 11, No. 377 (M-649)(2824) Dec. 9, 1987, & JP-A-62 148292 (Oji Yuki Gouseishi K.K.) Jul. 2, 1987.

Patent Abstracts of Japan, vol. 12, No. 14 (M-659)(2861) Jan. 16, 1988, & JP-A-62 174190 (Matsushita Electric Ind Co. Ltd.) Jul. 30, 1987.

Patent Abstracts of Japan, vol. 13, No. 154 (M-814)(3502) Apr. 14, 1989, JP-A-63 315293 (Oji Yuka Gouseishi K.K.) Dec. 22, 1988.

Patent Abstracts of Japan, vol. 13, No. 229 (M-831)(3577) May 26, 1989, & JP-A-1 44781 (Dainippon Printing Co. Ltd.) Feb. 17, 1989.

*Primary Examiner*—Bruce H. Hess

*Attorney, Agent, or Firm*—Sughrue, Mion, Zinn, Macpeak & Seas

[57] ABSTRACT

Thermal transfer image reception paper is disclosed which comprises an image reception paper base material constituted by a core material and two sheets of synthetic paper provided on the both sides of the core material, respectively, a dyeable resin layer provided on at least one surface of the image reception paper base material directly or through an intermediate layer; each sheet of said synthetic paper having a composite structure including at least two layers; one of the at least two layers located on the resin layer side being a paper-like layer having fine pores.

11 Claims, 2 Drawing Sheets

THERMAL TRANSFER IMAGE RECEPTION PAPER

This is a continuation of application Ser. No. 07/411,284, filed Sep. 22, 1989, now abandoned.

FIELD OF THE INVENTION

The present invention relates to thermal transfer image reception paper. Particularly, the present invention relates to a thermal transfer image reception paper for use in a thermal recording system in which the thermal transfer image reception paper and a thermo-sensitive transfer paper having a color material layer containing a sublimation dye are superimposed to each other, and the lamination of the two sheets of paper is heated by a thermal head or the like whereby the sublimation dye in the thermo-sensitive transfer paper is sublimated, and then migrated to the image reception paper so as to perform color recording.

BACKGROUND OF THE INVENTION

Recently, a personal computer, a television, a VTR, a video disc and the like have become popular and a color display and the like have been widely used as information terminals. The demand for printers for outputting colored still pictures of these terminals has increased. Examples of the recording system of a full-color printer include an electrophotographic system, an ink jet system and a thermo-sensitive transfer system. Of those systems, the thermo-sensitive transfer system has been widely used because it generate little noise and can easily be maintained.

In the thermo-sensitive transfer system, a thermo-sensitive transfer paper in which color ink is fixed and a sheet of image reception paper are used, and recording is made in a manner so that the ink is fusion-transferred or sublimation-transferred onto the image reception paper by controlled thermal energy of a laser, a thermal head or the like in accordance with electric signals.

That is, thermo-sensitive transfer systems may be grouped into a system of the thermal-fusing transfer type and a system of the sublimation-transfer type which use sublimation dyes.

In the system of the heat-fusing transfer type, an ink sheet carrying pigment or dye bound thereon with thermo-fusible wax is used. When the pigment or dye is transferred onto the image reception paper, the wax fused by the thermal energy of the thermal head is also transferred together with the ink. This system of the thermal-fusing transfer type therefore has a disadvantage that it is difficult to obtain half tones required for the necessary image quality and that it is impossible to obtain good hue because of the presence of the transferred wax.

On the other hand, the system of the sublimation-transfer using sublimation dyes is an application of the conventional sublimation-transfer textile printing technique. In this system, a sheet having thereon a dispersed dye which can be relatively easily sublimated bound with a binder is used, so that the dye is sublimated and transferred onto the image reception paper to thereby obtain an image thereon by thermal energy from a thermal head. The sublimation dye is sublimated in accordance with the thermal energy of the thermal head; accordingly, this system has advantages in that it is possible to obtain half tones easily and it is possible to selectively control graduation. The sublimation-transfer system is the most suitable for a full-color printer.

As the thermal transfer image reception paper for use in the thermal transfer system of this sublimation-transfer type, that in which a layer made of thermoplastic resin, which may be effectively dyed by the sublimation dye, such as polyester resins, polyamide resins, epoxy resins, or the like (hereinafter the layer being simply referred to "a dyeable resin layer") is provided on printing base paper which functions as a base material of an image reception paper, as disclosed, e.g., in JP-A-57-107885 (the term "JP-A" as used herein means an unexamined published Japanese patent application).

In the thermal transfer image reception paper provided with such a dyeable resin layer formed on a base material, in the case where ordinary paper is used as the base material, it is necessary to make the voltage to be applied to a thermal head high because the color density is generally low in comparison with synthetic paper, and the color density becomes irregular because of large surface unevenness in ordinary paper. In the case where synthetic paper having a single layer structure, that is, synthetic paper made of polyolefin, polystyrene, or the like, is used as the base material, there is an advantage in that it is possible to obtain sufficient color density as well as excellent image quality. In the latter case of using synthetic paper, however, there are problems. Because synthetic paper is generally stretched so as to increase strength and to provide fine pores, the synthetic paper is shrunk when it is heated in printing by a thermal head only from the side at which the dyeable resin layer is provided. Therefore, distortion is caused between the opposite surfaces of the base material to thereby cause remarkable curl.

In order to prevent these difficulties, i.e., occurrence of curl, then using synthetic paper, there has been proposed an image reception paper base material constituted by two layers of synthetic paper and a backing material (backing layer). That is, a dyeable resin layer is formed on one surface of synthetic paper, and a plastic film or cellulose type fibrous paper is provided as a backing layer on the other surface of the synthetic paper, so that shrinkage of the synthetic paper due to heat upon printing is prevented by the rigidity of the backing layer to thereby prevent the occurrence of curl. The curl amount ($\delta$) occurring in the image reception paper base material having such a two-layer structure upon printing may be obtained based on the bimetal theory as follows.

$$\delta = \frac{l^2(\alpha_1 T_1 - \alpha_2 T_2)}{h} \times \frac{6E_1E_2}{(E_1 + E_2)^2 + 12E_1E_2} \quad (1)$$

wherein $E_1$ and $E_2$ represent Young's moduli of the backing material and the synthetic paper, respectively; $\alpha_1$ and $\alpha_2$ represent coefficients of thermal expansion of the backing material and the synthetic paper, respectively; h represents the total thickness of the synthetic paper and the backing material; l represents twice the length of the image reception paper base material in the longitudinal direction; h represents the thickness of the backing layer which is the same as that of the synthetic paper for convenience; $T_1$ represents the temperature of the backing layer upon printing; and $T_2$ represents the temperature of the synthetic paper upon printing.

In equation (1), in the case of synthetic paper, when $\alpha_2 < 0$, thermal shrinkage is caused by heat. Generally, the relation $T_2 > T_1$ is satisfied. In order to reduce the curl ($\delta$) in equation (1), it is effective to select synthetic paper having less thermal shrinkage and to select a backing material having a small coefficient of thermal expansion $\alpha_1$. It is effective in reducing the curl to increase the thickness h. As to the Young's moduli, the second term of the equation (1).

$$\frac{6E_1E_2}{(E_1 + E_2)^2 + 12E_1E_2}$$

becomes $6E_2/E_1$ when $E_1 >> E_2$, $6E_1/E_2$ when $E_1 << E_2$, and $\frac{3}{8}$ (which is the maximum) when $E_1 = E_2$. In order to reduce the curl, therefore, it is necessary to select a combination of $E_1$ and $E_2$ having as large a difference as possible. Because polyolefin type synthetic paper generally includes fine pores inside, it has Young's modulus $E_2$ of about $10^8$ to $10^9$ dyne/cm$^2$ which is smaller than the Young's modulus of other plastic films of $10^9$ to $10^{10}$ dyne/cm$^2$.

Thus, as to the backing material, a so-called high-rigidity material having a great thickness, a high modulus of elasticity, and a low coefficient of thermal expansion is highly effective in preventing curl upon printing.

On the other hand, not only the curl occurring in printing but also the curl occurring before printing becomes a problem. That is, the flatness of the image reception paper deteriorates under various preserving conditions before printing, and therefore the image reception paper cannot be fed well due to the curl thereof when the image reception paper is fed into a printer thereby making printing impossible. Particularly in printers developed recently, in order to simplify the printing operation, an automatic paper-feed system is used and the occurrence of the curl before printing becomes a more serious problem in view of the need for smooth paper feeding. In other words, the prevention of curl before printing is considered to an indispensable condition for carrying out printing, which is therefore more important than prevention of curl after printing.

In order to prevent the curl before printing when image reception paper is returned to the ordinary state (at room temperature and humidity (60±5% RH)) after it has been stored under a predetermined preserving condition for predetermined hours (for example, 72 hours), it is desirable that the base material of the image reception paper has a single layer structure or, in the case of a multi-layer structure, has as symmetrical structure as possible in the direction perpendicular to the layers. That is, curl hardly occurs if transformation is balanced between the opposite sides of the image reception paper base material when the image reception paper is returned from the state under the preserving condition to the ordinary state.

In view of prevention of curl before printing, use of a highly rigid material as a backing material for the purpose of reduction of the curl after printing not only has no effect in reduction of the curl before printing but rather promotes the curl before printing.

For example, when an image reception paper base material of a two-layer structure in which synthetic paper of 60 μm polypropylene (hereinafter simply referred to "PP") and a 75 μm polyethylene terephthalate (hereinafter simply referred to "PET") film including titanium white are bonded to each other through an acrylic resin tackifier (5 to 10 μm) was left at a temperature of 60° C. for 72 hours, the flatness of the image reception paper base material was maintained and ensured under the temperature of 60° C. because of the stress-relaxation function of the tackifier. But, when the image reception paper base material was returned to the ordinary state, curl having a concave surface at the PP synthetic paper side was observed.

On the other hand, if printing is made on image reception paper in which a dyeable resin layer is provided on the PP synthetic paper side of the base material having such a two-layer structure as described above, the curl after printing is extremely small in comparison to the case where the dyeable resin layer is provided on the base material composed of only PP synthetic paper.

In order to suppress the curl before printing, it is effective to use a base material having a multi-layer structure (for example, three layers, five layers, etc.) which is made as symmetrical as possible. In order to suppress the curl after printing, it is desired that layers other than that on the synthetic paper side having a dyeable resin layer formed thereon bring the restricting effect against the thermal transformation due to printing, as disclosed, for example, in JP-A-U-61-188866, and JP-A-61-258793 and JP-A-62-198497 (the term "JP-A-U" used herein means an unexamined published Japanese utility model application). Accordingly, it has been much desired to develop thermal transfer image reception paper which can satisfy both the requirements described above.

SUMMARY OF THE INVENTION

It is therefore an object of the present invention to eliminate the difficulties in the conventional thermal transfer image reception paper as described above.

It is another object of the present invention to provide thermal transfer image reception paper in which the prevention of the curl both before and after printing can be achieved.

The above and other objects of the present invention will be more apparent from the following description.

As the result of various investigations for the purpose of solving the foregoing problems, the present inventors have found that the above objects of the present invention can be achieved when a material, in which two sheets of synthetic paper each having a paper-like layer having fine pores formed only on one side thereof are bonded on the both sides of a core material, is used as an image reception paper base material.

That is, the present invention relates to thermal transfer image reception paper comprising:

an image reception paper base material constituted by a core material and two sheets of synthetic paper provided on the both sides of the core material, respectively;

a dyeable resin layer provided on at least one surface of the image reception paper base material directly or through an intermediate layer;

each sheet of the synthetic paper having a composite structure including at least two layers;

one of the at least two layers located on the resin layer side being a paper-like layer having fine pores.

DETAILED DESCRIPTION OF THE INVENTION

Figure 1:
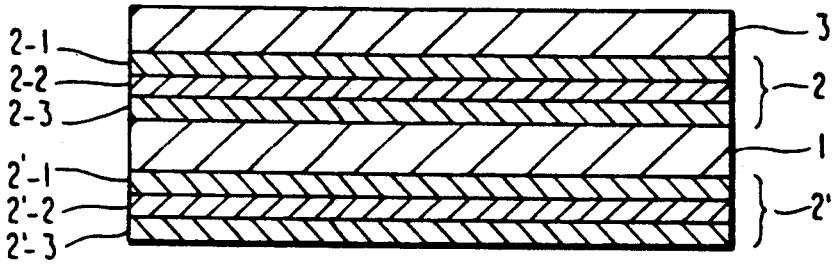
FIGS. 1 and 2 are schematic sectional views of various embodiments of the thermal transfer image reception paper of the present invention.

Referring to the drawings, the present invention will be described in detail hereunder.

Figure 2:
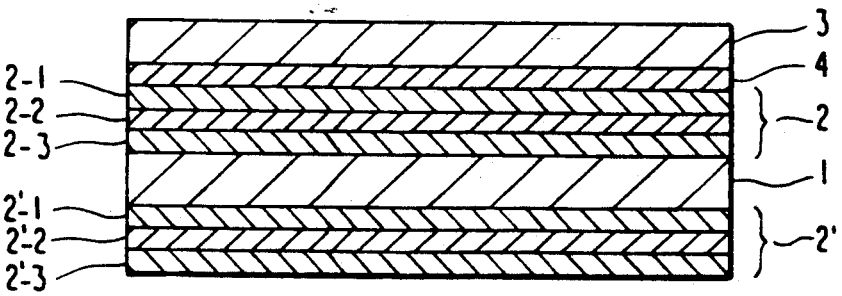

FIG. 1 is an embodiment of a basic structure of the thermal transfer image reception paper according to the present invention. An image reception paper base material has a three-layer structure of a core material 1 and two sheets of synthetic paper 2 and 2'. The synthetic paper 2 is constituted by a paper-like layer 2-1 having fine pores, a synthetic paper core layer 2-2 and a synthetic paper backing layer 2-3. The synthetic paper 2' is constituted by a paper-like layer 2'-1 having fine pores, a synthetic paper core layer 2'-2 and a synthetic paper backing layer 2'-3. The image reception base material has an asymmetrical structure relative to the core material 1. A dyeable resin layer 3 is provided on the paper-like layer 2-1 of the synthetic paper 2 directly. The dyeable layer may be provided through an intermediate layer 4 as shown in FIG. 2.

Figure 3:
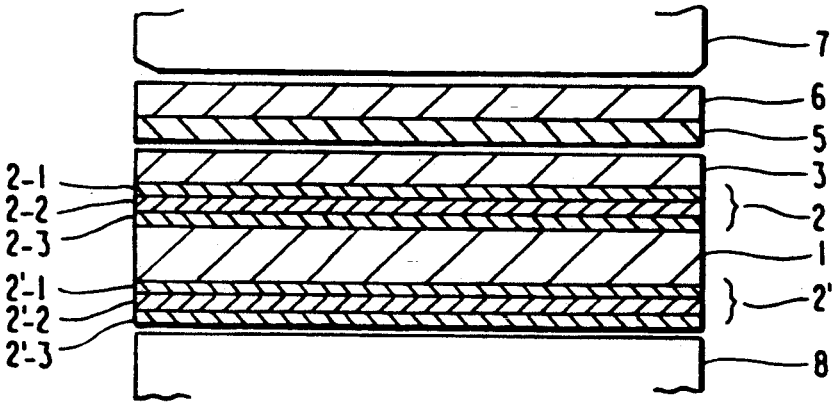
FIG. 3 is a schematic view for explaining the thermal transfer printing performed by use of thermo-sensitive transfer paper.

FIG. 3 is a view for explaining the state in which printing is performed by use of the thermal transfer image reception paper according to the present invention and a thermo-sensitive transfer paper. In FIG. 3, the thermo-sensitive transfer paper is composed of an ink layer 5 and a thermo-sensitive transfer base film 6. A thermal head for printing is represented by 7, and a platen roll is represented by 8.

Figure 4:
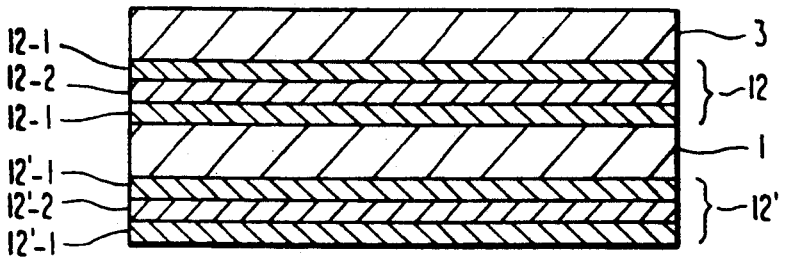
FIG. 4 (PRIOR ART)
FIG. 4 is a schematic sectional views of a conventional thermal transfer image reception paper.

FIG. 4 shows an example of the conventional image reception paper in which a synthetic paper core layer provided with paper-like layers on the both sides thereof is used as the synthetic paper which is provided on both sides of a core material. That is, the conventional image reception paper is constituted by a base material having a three-layer structure in which a core material 1 is disposed in the center and two sheets of synthetic paper 12 and 12' having paper-like layers 12-1 and 12'-1, and synthetic paper core layers 12-2 and 12'-2, respectively, are bonded on the both sides of the core material 1 respectively. A dyeable resin layer 3 is provided on the paper-like layer 12-1.

As the result of investigation by the present inventors, it has been found that in the conventional image reception paper shown in FIG. 4, since the base material per se has a symmetrical structure, there hardly occurs curl when the image reception paper is left under preservation condition before printing. After printing, however, the curl is not effectively prevented because the thermal transformation of the synthetic papers 12 and 12' is large, and the rigidity of the back-side synthetic paper 12' (the synthetic paper on the side opposite to the side on which the dyeable resin layer is provided) which should act as a transformation restricting layer is low.

In the conventional PP synthetic paper, generally, the thickness ratio of (fine porous layer)/(core layer)/(fine porous layer) is about 1/2/1. The image printed by use of the dyeable resin layer provided on the fine porous layer of the PP synthetic paper has a high image density and low unevenness of density due to the adiabatic effect and cushioning property of the fine porous layer. These characteristics are originally brought by the fine porous layer's contact with the dyeable resin layer, and it has been confirmed that even if the fine porous layer is extremely thin as about 10 to 30 μm, the high image density and the low unevenness of density can be realized. Thus, the thickness of the fine porous layer is preferably from 10 to 30 μm. The thickness of the synthetic paper core layer is from 20 to 60 μm.

As described above, in the conventional image reception paper, in order to suppress the curl of the synthetic paper layer after printing, the restricting effect of the back-side synthetic paper is enhanced.

It is necessary to make the sheets of synthetic paper used on the both sides of the core material be the same structure in view of the problem of the curl before printing. The fine porous layer is indispensable in order to obtain an image having high image density and low unevenness of density.

According to the present invention, on the contrary, as shown in FIG. 1, since the synthetic paper has a multi-layer structure in which only the layer on one side of the synthetic paper is a paper-like layer having fine pores, not only the transformation of the synthetic paper on the front surface side on which the dyeable resin layer is provided is small, but also the transformation restricting effect for the synthetic paper bonded on the back side of the core material is large. Accordingly, the curl caused by printing can be made extremely small. Further, since the sheets of synthetic paper having the same structure are bonded onto both sides of the core material respectively, the curl before printing is extremely small.

The effect on the curl before printing is substantially the same in the case where the synthetic paper 2' is bonded at the paper-like layer 2'-1 side onto the core material 1 and the case where the synthetic paper 2' is bonded at the backing layer 2'-3 side onto the core material 1. With respect to the curl after printing, on the contrary, the restricting effect for the transformation of the synthetic paper on the back side of the core material 1 is large so that the curl is made small when the synthetic paper 2' is bonded onto the core material 1 in the order of the present invention as shown in FIG. 1.

The core material 1 used in the present invention may generally be ordinary paper or plastic films. Further, a lamination of ordinary paper and plastic films bonded on each other may be used. Examples of the ordinary paper include high grade or woodfree paper, middle grade paper, art paper, coat paper, wall paper, backing paper, paper impregnated with synthetic resins, emulsions thereof, synthetic rubber latex, or the like, paper including synthetic resins therein, and the like. Examples of the plastic film include films of PET, polyolefin, poly(vinyl chloride), polystyrene, polymethacrylate, polycarbonate, polyamide, a copolymer of ethylene-vinyl acetate, a copolymer of ethylene-vinyl alcohol-vinyl acetate, and the like. The thickness of the core material 1 is preferably from 30 to 300 μm, and more preferably from 40 to 100 μm.

The core material 1 and the synthetic paper 2 and 2' may be bonded with each other by use of an adhesive or a tackifier, or by an extrusion lamination method. Particularly, in the case where the core material 1 is of plastic film, it is preferable to bond the core material and the synthetic paper with each other by the lamination method or a calender method in which the core material can be bonded with the synthetic paper simultaneously with the production of the core material.

The adhesive and the tackifier may be an organic solvent inclusive type such as an acrylic resin, a polyurethane resin, an epoxy resin, a polybutylal resin, etc.; an emulsion type such as polyvinyl acetate, a copolymer of ethylene-vinyl acetate; of a water inclusive type such as polyvinyl alcohol, etc.; or the like.

As the dyeable resin layer, various kinds of materials which have sufficient coloring properties for a sublimation dye can be widely used (as described, e.g., in JP-A-57-107885). For example, a polyester resin, an epoxy resin, a polyurethane resin, a polyamide resin, an acrylic resin, a cellulose acetate resin, a butylal resin, a vinyl acetate resin, or the like, or any mixtures or copolymers of them may be used. The dyeable resin layer may be partially cross-linked if necessary. Further, a filler such as silica, talc, potassium carbonate, titanium oxide, zinc oxide, or the like may be added if necessary. The thickness of the dyeable resin layer is preferably from 5 to 15 μm.

The dyeable resin layer may be formed any of coating method such as gravure coating, roll coating including reverse roll coating, wire bar coating, fountain coating, etc.

The dyeable resin layer 3 may be provided directly on the paper-like layer 2-1 including fine pores as shown in FIG. 1, or may be provided through an intermediate layer 4 as shown in FIG. 2. The intermediate layer 4 is provided for improving the tightness between the dyeable layer and ink layer of the thermo-sensitive transfer paper to thereby prevent lowering of color density and occurrence of unevenness in color density which may be caused by poor tightness. The material of the intermediate layer 4 may be a covalent cross-liking type elastomer (generally called valcanized rubber) such as natural rubber, isobutylene-isoprene rubber, nitrile rubber, or the like; a polyurethane resin; an acrylic resin; a polyester resin; a polyolefin resin; or the like.

An inorganic vulcanizing agent, an organic vulcanizing agent, a vulcanization accelerator, an activator, an aging inhibitor, a peptizer, a softener, a reinforcer, a filler, a weather-resistance improving agent, or the like, which has been conventionally known, may be added to the intermediate layer 4 if necessary. The thickness of the intermediate layer 4 is preferably from about 1 to 50 μm, more preferably from about 3 to 15 μm.

After dissolution in a suitable organic solvent, or adjustment to a suitable viscosity as an emulsion, the aforementioned ingredients for the intermediate layer are applied by any application means such as a roll coater, a kiss coater, a gravure coater, an air knife coater, or the like and dried to be the intermediate layer. The thermo-plastic materials may be coated by extrusion coating such as an accumulator, or the like.

As described in detail above, two sheets of synthetic paper each having a multi-layer structure including only on one-side a paper-like layer containing fine pores are bonded on both sides of a core material in a manner so that the paper-like layer of at least one of the two sheets of synthetic paper is disposed outside. A dyeable resin layer is provided on the outside-disposed paper-like layer directly or through an intermediate layer so that not only the curl after printing but also the curl caused by preservation before printing can be reduced.

The present invention will be described hereunder in more detail referring to various examples. In the following examples, the term "part" means "part by weight", and the curl after being left under preserving conditions before printing and the curl after printing were measured in the following manner, respectively.

Figure 5:
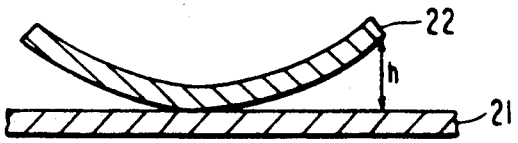
FIGS. 5, 6, and 7 are views for explaining the curl amount measuring method.
Figure 6:
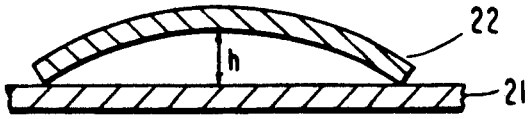

The curl after preserving before printing (FIGS. 5 and 6)

Two sheet of image reception paper 22 each having a width of 100 mm and a length of 128 mm were left in an atmosphere of 40° C. and 95% RH and in an atmosphere of 60° C. (the humidity was not controlled), respectively, for 24 hours. Then, after the sheets of image reception paper 22 were taken out and left in the ordinary state for 6 hours, they were put on flat horizontal plates 21 with their dyeable layers faced downward as shown in FIG. 5 or 6. The maximum values of heights h or h' showing the degree of curl were measured.

Figure 7:
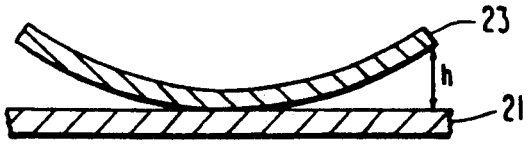

The curl after printing (FIG. 7)

Printing was performed by use of a sheet image reception paper 23 having a width of 100 mm and a length of 128 mm so that the highest image density can be obtained under the thermal head recording conditions of 6 dots/mm with an applied voltage of 0.4 W/dot, and then the image reception paper 23 was put on a flat horizontal plate 21 with the printed surface faced upward. The maximum value of the height h" showing the degree of curl was measured.

EXAMPLE 1

An ink composition composed of 10 parts of a sublimating dispersed dye (KAYASET RED 126 made by Nippon Kayaku Co., Ltd.), 10 parts of a polyamide resin (VERSALON 1140 made by Henkel Hakusui Corp.), 40 parts of toluene, and 40 parts of isopropyl alcohol was dispersed by ultrasonic waves for 6 hours. The dispersed ink composition was applied onto a polyester film of 6 μm thick by means of a gravure coater and dried so that the dried coating amount was 2 g/m$^2$, thereby producing thermo-sensitive transfer paper.

A dyeable resin composition composed of 20 parts of a saturated polyester resin (VYLON #200 made by Toyobo Co., Ltd.), 3 parts of a polyisocyanurate compound (CORONATE made by Nippon Urethane Co., Ltd.), 1 part of amino-modified silicone (KF-393 made by Shin-etsu Chemical Co., Ltd.), 1 part of epoxy-modified silicone (X-22-343 made by Shin-etsu Chemical Co., Ltd.), 40 parts of methyl ethyl ketone, and 40 parts of toluene was prepared by mixing and dissolving these ingredients.

A first sheet of 60 μm thick polypropylene synthetic paper having a multi-layer structure constituted of three layers (each consisting of polypropylene resins) was prepared, the three layers including a biaxially oriented middle layer provided on one side with a layer having fine pores and on the other side with a layer having no fine pores. A polystyrene aqueous emulsion (concentration of 20 wt %) was applied onto the layer of the synthetic paper having no fine pores and then dried. A sheet of high grade paper (grammage of 52 g/m$^2$) as a core material was put on the aforementioned layer having no fine pores of the first sheet of synthetic paper and bonded thereon by means of heat rolls at a temperature of 85° C. The polystyrene aqueous solution was further applied onto the other surface of the high grade paper on which no synthetic paper was bonded. Then, after the coating of the polystyrene aqueous solution had been dried, a second sheet of synthetic paper having the same structure as the first sheet was bonded, under the aforementioned bonding conditions, onto the above-mentioned other surface of the high grade paper such a manner that the layer having fine pores of the second sheet of synthetic paper was made contact with the high grade paper. Thus, an image reception paper base material was prepared.

Next, the surface of the outside-located layer having fine pores of the first sheet of synthetic paper of the above-prepared image reception paper base material was coated with the aforementioned dyeable resin composition by using a wire bar to a dried coating amount of 10 g/m$^2$. The coating was then dried at 110° C. for 3 minutes, and further aged at 50° C. for 24 hours. Thus, a thermal transfer image reception paper having the structure as shown in FIG. 1 was prepared.

Two sheets of the thus obtained thermal transfer image reception paper were left in a thermohygrostat of 40° C. and 95% RH and in a thermostat of 60° C., respectively, for 24 hours. Then, the two sheets were taken out, and left in the ordinary state for 6 hours. Then, the curl after the preservation before printing was measured. Table 1 shows the result of the measurement.

After printing had been performed by use of the thus obtained thermal transfer image reception paper and the thermo-sensitive transfer paper so that the highest image density could be obtained under the thermal head recording conditions of 6 dots/mm and applied voltage of 0.4 W/dot, the curl after printing was measured. The result of measurement is shown also in Table 1.

EXAMPLE 2

A first sheet of 60 μm thick polypropylene synthetic paper having a multi-layer structure constituted of three layers (each consisting of polypropylene resins) was prepared, the three layers including a biaxially oriented middle layer provided on one side with a layer having fine pores and on the other side with a layer having no fine pores. A solution of polypropylene chloride dissolved in a mixed solvent of toluene and methyl ethyl ketone (mixing ratio: 1/1 by weight) was applied onto the surface of the layer of the first sheet of synthetic paper having no fine pores, and then the coating was dried. The first sheet of synthetic paper was dry-laminated on a polyethylene terephthalate film as a core material having a thickness of 60 μm through a urethane adhesive. Further, the solution of polypropylene chloride dissolved in a mixed solvent of toluene and methyl ethyl ketone (mixture ratio: 1:1 by weight rate) was applied onto the surface of the layer having fine pores of a second sheet of polypropylene synthetic paper having the same structure as that of the first sheet of synthetic paper, and then the coating was dried. The second synthetic paper was dry-laminated on the polyethylene terephthalate film on the surface thereof opposite to the surface on which the first sheet of synthetic paper had been already bonded, by using the urethane adhesive. Thus, the image reception paper base material was prepared. Next, similarly to Example 1, a dyeable resin layer was provided on the outside-located layer having fine pores of the image reception paper base material. The curl after preserving before printing and the curl after printing were measured in the same manner as in the Example 1. The result of measurement is shown also in the Table 1.

EXAMPLE 3

The surface of the outside-located layer having fine pores of the first sheet of synthetic paper of the image reception paper base material prepared in Example 1 was coated with a solution of 20 parts of a thermoplastic elastomer (CARIFLEX TR1007 made by Shell Chemical Co., Ltd.) and 80 parts of toluene by means of a roll coater a dried amount of 10 g/m$^2$. The coating was dried so as to form an intermediate layer. Further, a dyeable resin layer was provided on the intermediate layer in the same manner as Example 1. The curl after preserving before printing and the curl after printing were measured in the same manner as in the Example 1. The result of measurement is shown also in the Table 1.

COMPARATIVE EXAMPLE 1

A first sheet of 60 μm thick polypropylene synthetic paper having a multi-layer structure constituted of three layers (each consisting of polypropylene resins) was prepared, the three layers including a biaxially oriented middle layer provided on the both sides thereof with layers having fine pores. A polystyrene aqueous emulsion was applied onto the surface of the first sheet of synthetic paper in the same manner as in the Example 1 and then the coating was dried. A sheet of high grade paper (grammage of 52 g/m$^2$) was put on the coated surface of the first sheet of synthetic paper and bonded thereon by means of heat rolls. A second sheet of polypropylene synthetic paper of the same structure as the first sheet was bonded in the same manner as above so as to prepare an image reception paper base material. A dyeable resin layer was provided on one side of the image reception paper base material in the same manner as Example 1. Then, the curl after preserving before printing and the curl after printing were measured in the same manner as in the Example 1. The result of measurement is shown also in the Table 1.

COMPARATIVE EXAMPLE 2

A sheet of 60 μm thick polypropylene synthetic paper having a multi-layer structure constituted by three layers (each consisting of polypropylene resins) was prepared, the three layers including a biaxially oriented middle layer provided on one side with a layer having fine pores and on the other side with a layer having no fine pores. A polystyrene aqueous emulsion was applied onto the surface of the layer having no fine pores of the sheet of synthetic paper and then the coating was dried. Then, a sheet of coat paper (grammage of 105 g/m$^2$) was bonded by a heat roll onto the polystyrene aqueous solution coated surface of the layer having no fine pores of the sheet of synthetic paper. A dyeable resin layer was provided on the porous layer side of the base material in the same manner as Example 1.

Then, the curl after preserving before printing and the curl after printing were measured in the same manner as in the Example 1. The result of measurement is shown also in the Table 1.

TABLE 1

| Sample | Curl before printing 40° C., 95% for 24 h (mm) | Curl before printing 60° C., 24 h (mm) | Curl after printing (mm) |
|---|---|---|---|
| Example 1 | 3 | 1 | 2 |
| Example 2 | 2 | 1 | 4 |
| Example 3 | 3 | 2 | 3 |
| Comparative Example 1 | 3 | 1 | 10 |
| Comparative Example 2 | 16 | 13 | 3 |

It is clear from the results shown in Table 1 that the thermal transfer image reception paper of the present invention attains excellent performance that both the curl before printing and that after printing are extremely small.

While the invention has been described in detail and with reference to specific examples thereof, it will be apparent to one skilled in the art that various changes and modifications can be made therein without departing from the spirit and scope thereof.

What is claimed is:

1. Thermal transfer image reception paper comprising:

an image reception paper base material constituted by a core material and two sheets of synthetic paper provided on both sides of said core material, respectively;

a dyeable resin layer provided on at least one surface of said image reception paper base material directly or through an intermediate layer;

each sheet of said synthetic paper having a composite structure including two layers;

one of the layers of said synthetic paper composite structure located on said resin layer side being a paper-like layer having fine pores, and only one layer of the composite structure of said synthetic paper located on each side of said core material being a paper-like layer having fine pores.

2. Thermal transfer image reception paper as claimed in claim 1, wherein said sheets of synthetic paper each having a composite structure including at least two layers are arranged so as to form an asymmetrical structure relative to said core material.

3. Thermal transfer image reception paper as claimed in claim 2, wherein said asymmetrical structure is configured by a lamination of said paper-like layer having fine pores, a layer having no fine pores, said core material, another paper-like layer having fine pores and another layer having no fine pores stacked in order.

4. Thermal transfer image reception paper as claimed in claim 3, wherein each layer having no fine pores is constituted by a synthetic paper core layer and a synthetic paper backing layer.

5. Thermal transfer image reception paper as claimed in claim 4, wherein said synthetic paper core layer is made of biaxially oriented plastics.

6. Thermal transfer image reception paper as claimed in claim 4, wherein said synthetic paper backing layer is made of polypropylene.

7. Thermal transfer image reception paper as claimed in claim 1, wherein said core material is ordinary paper or a plastic film.

8. Thermal transfer image reception paper as claimed in claim 1 wherein the thickness of the intermediate layer is from about 1 50 μm.

9. Thermal transfer image reception paper as claimed in claim 1 wherein the thickness of the intermediate layer is from about 3 to 15 μm.

10. Thermal transfer image reception paper as claimed in claim 1 wherein the thickness of the core material is about 30 to 300 μm.

11. Thermal transfer image reception paper as claimed in claim 1 wherein the thickness of the core material is about 40 to 100 μm.

* * * * *